US011232779B1

(12) United States Patent
Feng

(10) Patent No.: US 11,232,779 B1
(45) Date of Patent: Jan. 25, 2022

(54) SYSTEM AND METHOD FOR INTELLIGENT ADJUSTMENT FOR FILTER(S) FOR ROAD NOISE CANCELLATION

(71) Applicant: Harman International Industries, Incorporated, Stamford, CT (US)

(72) Inventor: Tao Feng, Novi, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/067,103

(22) Filed: Oct. 9, 2020

(51) Int. Cl.
*G10K 11/178* (2006.01)

(52) U.S. Cl.
CPC .. *G10K 11/17854* (2018.01); *G10K 11/17873* (2018.01); *G10K 11/17883* (2018.01); *G10K 2210/12* (2013.01); *G10K 2210/1282* (2013.01); *G10K 2210/3025* (2013.01); *G10K 2210/3028* (2013.01)

(58) Field of Classification Search
None
See application file for complete search history.

(56) References Cited

U.S. PATENT DOCUMENTS

2017/0323631 A1* 11/2017 Close ..... G10K 11/17855
2021/0241748 A1* 8/2021 Hera ..... G10K 11/17883

* cited by examiner

*Primary Examiner* — Kenny H Truong
(74) *Attorney, Agent, or Firm* — Brooks Kushman P.C.

(57) ABSTRACT

In at least one embodiment, a system for performing active noise cancelation in a vehicle is provided. The system includes an adaptive filter and an adjustment controller. The adaptive filter is configured to control a loudspeaker to generate anti-noise to cancel undesired noise in the vehicle. The adjustment controller is programmed to receive a reference signal from one or more accelerometers. Each reference signal includes a frequency that is indicative of a force acting on a portion of the vehicle. The adjustment controller is programmed to compare the frequency to a predetermined frequency threshold and to control a first filter to filter to the frequency based on the comparison of the frequency to the predetermined frequency threshold. The adjustment controller is programmed to transmit a filtered reference signal to the adaptive filter to generate the anti-noise without influence of the frequency of the reference signal.

20 Claims, 7 Drawing Sheets

SYSTEM AND METHOD FOR INTELLIGENT ADJUSTMENT FOR FILTER(S) FOR ROAD NOISE CANCELLATION

TECHNICAL FIELD

Aspects disclosed herein generally relate to a system and a method for intelligent adjustment for filter(s) for active noise cancellation. In one example, the aspects disclosed herein generally relate to a system and method for intelligent adjust for anti-aliasing filters in a road noise cancellation (RNC) system for a vehicle. These aspects and other will be discussed in more detail below.

BACKGROUND

Road Noise Cancellation (RNC) systems may be an effective and efficient approach to cancel the low frequency interior noise in a vehicle. However, in some instances, the RNC system (or other active noise cancellation systems) may inherently provide an undesirable boosting issue at high frequency range. Such a boost in the high frequency range may be attributed to one or more accelerometer signals that include a high power at the high frequency range.

SUMMARY

In at least one embodiment, a system for performing active noise cancelation (ANC) in a vehicle is provided. The system includes an adaptive filter and an adjustment controller. The adaptive filter is configured to control a loudspeaker to generate anti-noise to cancel undesired noise in the vehicle. The adjustment controller is programmed to receive one or more reference signals from one or more accelerometers. Each reference signal including a frequency and being indicative of a force acting on a portion of the vehicle. The adjustment controller is programmed to compare the frequency to a predetermined frequency threshold and to control a first filter to filter to the frequency based on the comparison of the frequency to the predetermined frequency threshold. The adjustment controller is programmed to transmit a filtered reference signal to the adaptive filter to generate the anti-noise without influence of the frequency of the reference signal.

In at least one embodiment, a computer-program product embodied in a non-transitory computer read-able medium that is programmed for performing active noise cancellation in a vehicle is provided. The computer-program product includes instructions for controlling a loudspeaker to generate anti-noise to cancel undesired noise in the vehicle and for receiving one or more reference signals from one or more accelerometers. Each reference signal includes a frequency that is indicative of a force acting on a portion of the vehicle. The computer-program product further includes instructions for comparing the frequency to a predetermined frequency threshold. The computer-program product further includes instructions for controlling a first filter to filter the frequency and for transmitting a filtered reference signal to the adaptive filter to generate the anti-noise without influence of the frequency.

In at least one embodiment, a method for performing active noise cancellation in a vehicle is provided. The method includes controlling a loudspeaker to generate anti-noise to cancel undesired noise in the vehicle and receiving one or more reference signals from one or more accelerometers. Each reference signal includes a frequency that is indicative of a force acting on a portion of the vehicle. The method further includes comparing the frequency to a predetermined frequency threshold. The method further includes controlling a first filter to filter the frequency of the reference signal and transmitting a filtered reference signal to the adaptive filter to generate the anti-noise without influence of the frequency.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilize one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices (e.g., FLASH, random access memory (RAM), read only memory (ROM), electrically programmable read only memory (EPROM), electrically erasable programmable read only memory (EE- PROM)) positioned within the housing. The controller(s) as disclosed also includes hardware-based inputs and outputs for receiving and transmitting data, respectively from and to other hardware-based devices as discussed herein.

Figure 1:
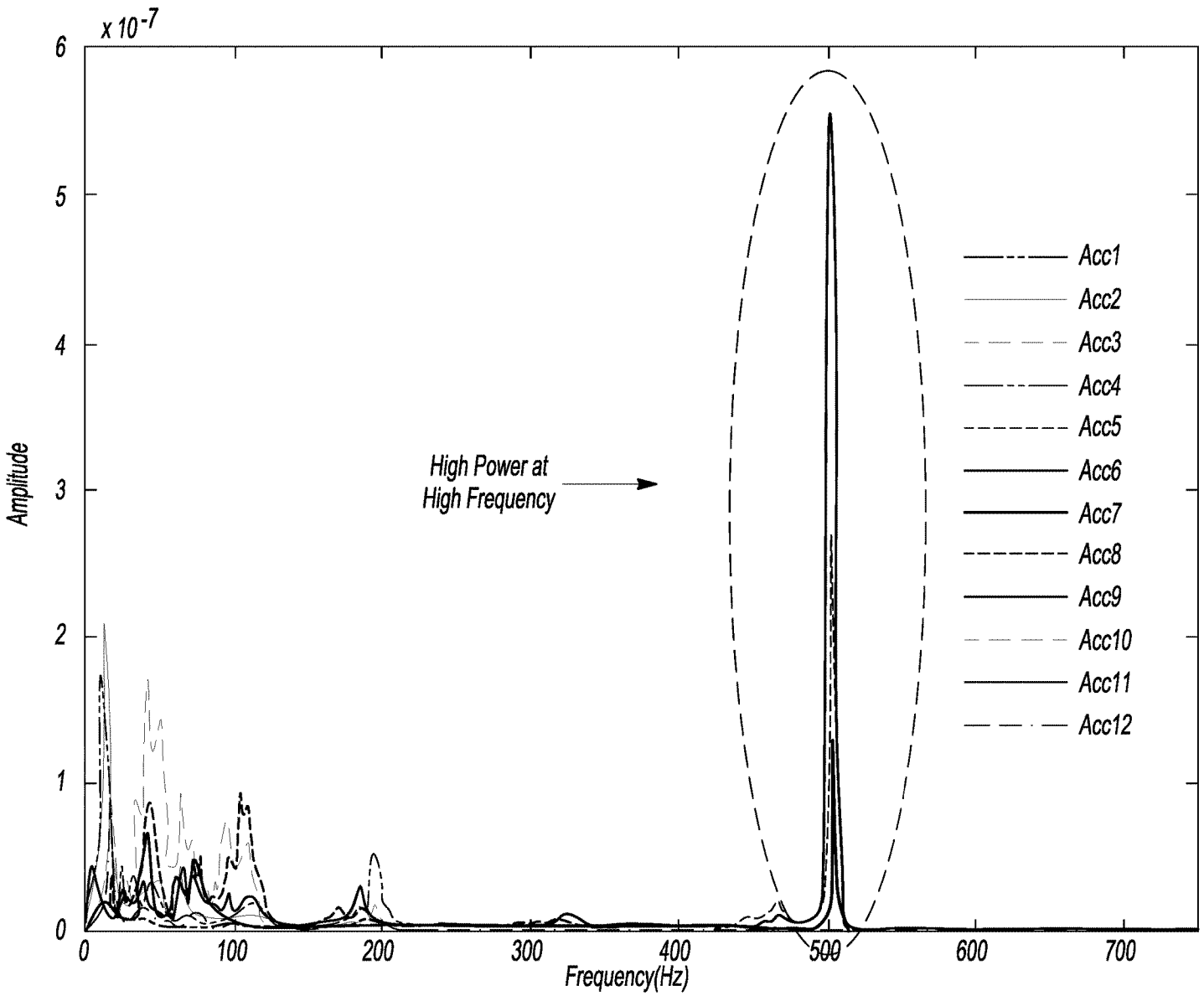
FIG. 1 is a plot that illustrates a frequency spectrum for a plurality of accelerometers in a vehicle.

Road Noise Cancellation (RNC) systems or other active noise cancellations systems (ANC) are an effective and efficient approach to cancel a low frequency interior noise in a vehicle cabin. However, in some conditions, the RNC system (or other active noise cancellation systems) provides a boosting issue at a high frequency range. One reason attributed to the boosting issue at the high frequency range is the presence of one or more accelerometers positioned in the vehicle that generate one or more accelerometer signals. The accelerometer signal generally consists of a high power at the high frequency range. FIG. 1 generally illustrates a frequency spectrum for a plurality of accelerometers positioned in the vehicle. As shown, at roughly 500 Hz, some accelerometers exhibit a spike in amplitude, which comes from vibration transmissions from road surfaces. Hence, the RNC system may generate the spike as the RNC system generates anti-noise to cancel the interior noise as the anti-noise is generated based on the accelerometer signal and an adaptive filter that is used in connection with the RNC system. If the accelerometer signal has a high value at the high frequency range, then the frequency response of the adaptive filter may be difficult to set to zero at the high frequency range. Due to this condition, the RNC system generates the spike.

In general, various attempts have been made to address the boosting issue. In one example, the accelerometers in the vehicle have been relocated to avoid generating the high frequency power in the accelerometer signal itself. However, automotive original equipment manufacturers (OEMs) have requirements which prevent the movement of the accelerometer sensors to other areas that may avoid generating the high frequency power. In addition, it is difficult to find a location in the vehicle that would prevent the accelerometer from exhibiting the high frequency power.

Another attempt may involve tuning parameters of the RNC system, such as step size and leakage, to control the adaptive filter as close to zero at the high frequency range. However, this may reduce RNC system performance and take more time to tune these parameters. In addition, another attempt may involve utilizing a lower cut-off frequency for an anti-aliasing (AA) filter. However, again, this approach may too limit RNC system performance.

In general, these attempts to resolve the high frequency issue brought on as a result of the accelerometer signal generally have limitations in terms of resolving the boosting issue but also maintaining RNC system performance. Aspects disclosed herein generally provide for an intelligent RNC methodology to prevent the boosting issue that occurs at high frequency ranges when the RNC system is active, and also to maintain the RNC system performance. For example, the disclosed aspects prevent the RNC system from the undesirably high frequency boosting issue in the vehicle while maintaining the RNC system performance in the passenger cabin. The disclosed RNC system provides, but not limited to, an intelligent adjustment anti-aliasing filter that employs a control topology. The control strategy is based on accelerometer or error microphone instability detection to detect the undesired high frequency characteristic on all accelerometer signals or error microphone signals and automatically adjust the AA filter to limit the boosting issue and maintain the RNC system performance.

RNC systems provide a broad band noise cancellation system to reduce the interior noise. RNC systems includes, but not limited to, adaptive filters to perform the anti-noise signal processing, and an adaptive algorithm for adjusting the adaptive filter. In general, an output from a loudspeaker y that may be driven by accelerometer signals x and an adaptive filter w, $$y=x*w$$

Figure 2:
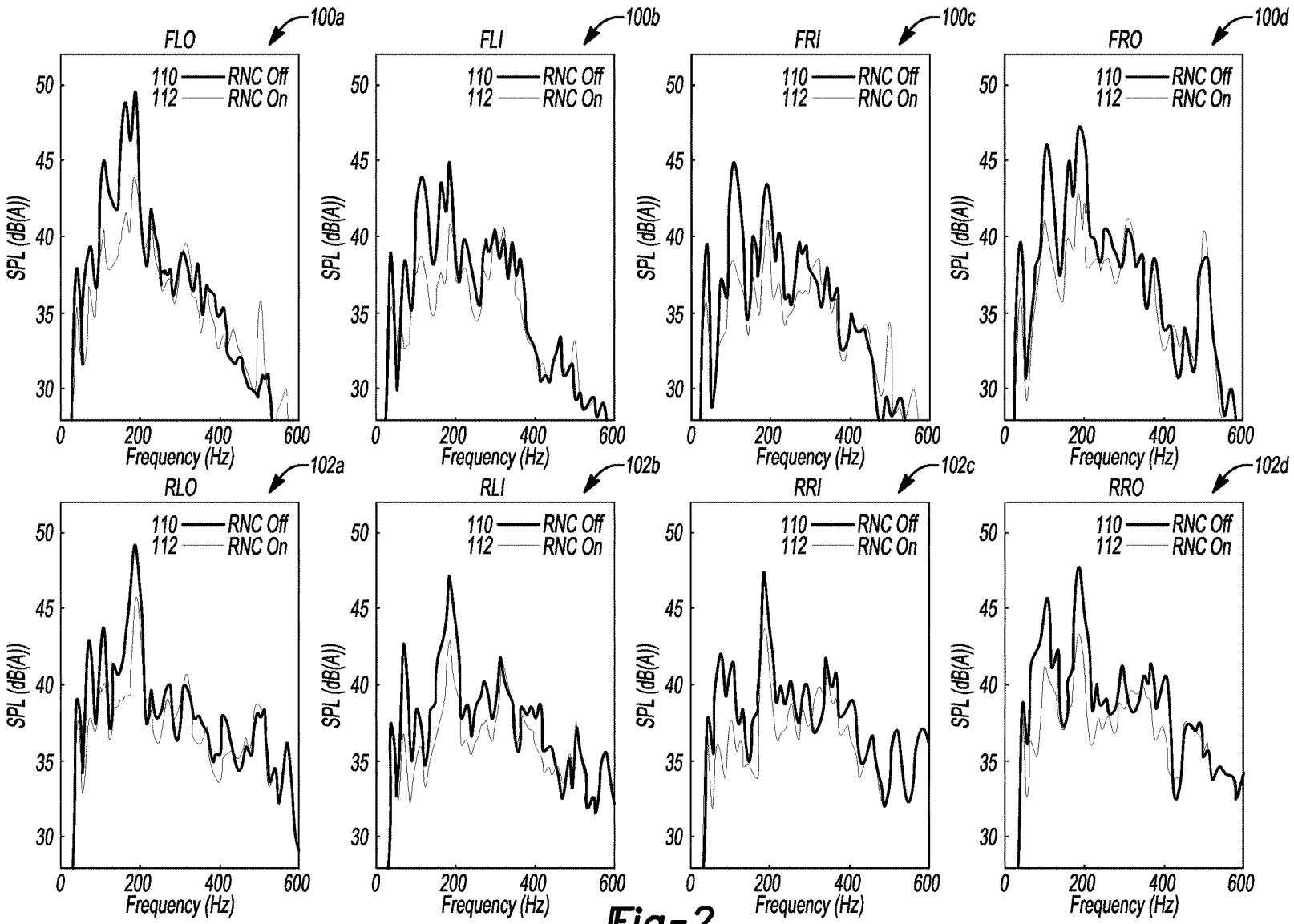
FIG. 2 depicts various plots that illustrate a spectrum for a plurality of error microphones in the vehicle that exhibit a boosting issue at various positions in the vehicle.

Assume the power of accelerometer at high frequency ranges above 400 Hz is higher, RNC system generates boosting issues as shown in FIG. 2. For example, FIG. 2 generally depicts various plots 100*a*-100*d* and 102*a*-102*d* that illustrate the spectrum for error microphones in the vehicle that capture frequencies from the accelerometers which exhibit a boosting issue at various positions in the vehicle. Plot 100*a* generally corresponds to the spectrum for an error microphone that is positioned in a front left side of a vehicle that is close to driver's left ear. Plot 100*b* generally corresponds to the spectrum for an error microphone that is positioned in the front left side of the vehicle that is close to the driver's right ear. Plot 100*c* generally corresponds to the spectrum for an error microphone that is positioned in a front right side of the vehicle that is close to the front right passenger's left ear. Plot 100*d* generally corresponds to the spectrum for the error microphone that is positioned in the front right side of the vehicle that is close to the front right passenger's right ear.

Similarly, plot 102*a* generally corresponds to the spectrum for an error microphone that is positioned in a rear left side of a vehicle that is close to the rear left passenger's left ear. Plot 102*b* generally corresponds to the spectrum for an error microphone that is positioned in the rear left side of the vehicle that is close to the rear left passenger's right ear. Plot 102*c* generally corresponds to the spectrum for an error microphone that is positioned in a rear right side of the vehicle that is close to the rear right passenger's left ear. Plot 102*d* generally corresponds to the spectrum for an error microphone that is positioned in the rear right side of the vehicle that is close to the rear right passenger's right ear.

Each of the plots 100*a*-100*d* and 102*a*-102*d* illustrate two waveforms therein. Waveform 110 as illustrated in each of the plots 100*a*-100*d* and 102*a*-102*d* correspond to the spectrum of the error microphones when the RNC system is deactivated. Waveform 112 as illustrated in in each of the plots 100*a*-100*d* and 102*a*-102*d* correspond to the spectrum of error microphones when the RNC system is activated. The plots 100*a*-100*d* and 102*a*-102*d* illustrate an undesired boosting of sound pressure of the anti-noise that is generated at around 500 Hz in the front driver and passenger portions due to the accelerometer signals. This condition is attributed to the accelerometer signal x (e.g., see plot FIG. 1) that has a high value at the high frequency range and that the loudspeaker output y generate anti-noise at the related high frequency unless the adaptive filter w at high frequency range is close to zero. As noted above, prior attempts to mitigate this issue have limitations (e.g., reduce the RNC system performance or requires a long-time tuning parameter, such as step size and leakage). Plots 100*a*, 100*b*, 100*c*, 100*d* generally exhibit increased levels of spikes in comparison to plots 102*a*, 102*b*, 102*c*, 102*d*. The spikes exhibited in the plots for 102*a*, 102*b*, 102*c*, and 102*d* are not as dramatic as those illustrated in connection with the plots 100*a*, 100*b*, 100*c*, and 100*d*. This is attributed due to the accelerometer signals including a high frequency power (see FIG. 2) focus on accelerometers mounted in the front sub-frame. This aspect will provide more coherence information to cancel the interior noise in the front of the vehicle other than the interior noise in the back of vehicle. Hence, the spectrum for the error microphone in the front of the vehicle noted in connection with 102*a*, 102*b*, 102*c*, and 102*d* may still generate spikes due to the anti-noise generate at around 500 Hz. Given that the various error microphones are positioned in close proximity to the vehicle occupant's ear, these conditions reflect the impact of the boosting issue that would otherwise be experienced by the vehicle occupants.

Figure 3:
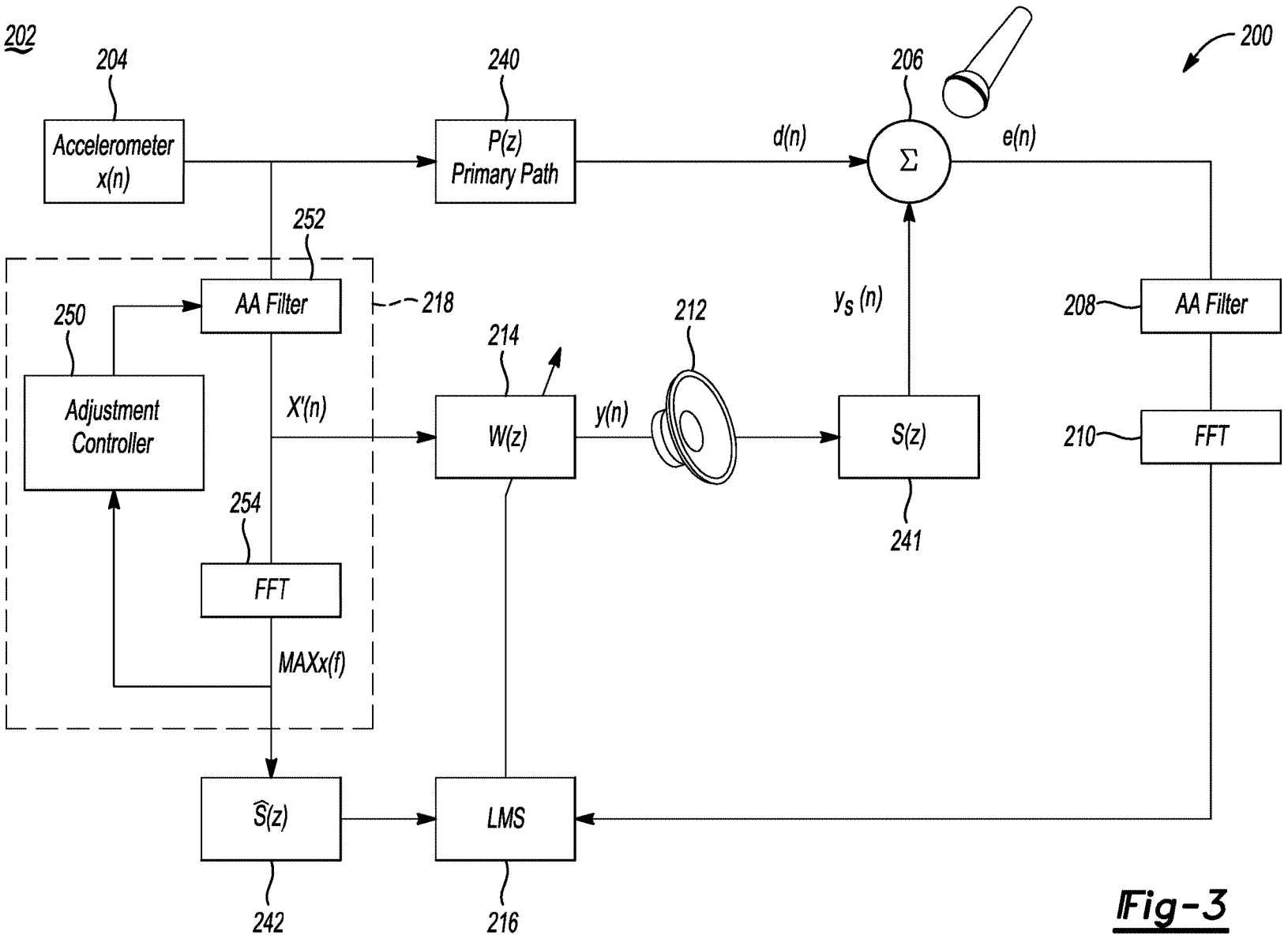
FIG. 3 depicts a road noise cancellation (RNC) system for a vehicle in accordance to one embodiment.

FIG. 3 generally depicts a (RNC) system 200 for a vehicle 202 in accordance to one embodiment. While the system 200 is referred to as an RNC system, it is recognized that the embodiments as disclosed herein may be applicable to any active noise cancellation (ANC) system that exhibits a boosting issue due to a high frequency component. The system 200 includes at least one accelerometer 204 (hereafter "the accelerometer 204"), at least one error microphone 206 (hereafter "the error microphone 206"), at least one filter (hereafter "the filter 208"), a Fast Fourier Transform (FFT) block 210, at least one loudspeaker 212 (hereafter "the loudspeaker 212), an adaptive filter 214, a least means square (LMS) block 216, and a filter control block 218.

The accelerometer 204 transmits a reference signal x(n) which traverses a primary path 240 and is received at the error microphone 206 as primary noise d(n). The reference signal x(n) corresponds to a measurement of vibration, or acceleration of motion of a structure that act on the vehicle 202. The error microphone 206 also receives anti-noise signal $y_s$ (n) that includes anti-noise generated by the loudspeaker 212. A secondary path 241 (e.g., S(z)) is formed between the loudspeaker 212 and the error microphone 206. The error microphone 216 generates an error microphone signal e(n) which is transmitted to the filter 208. In one example, the filter 208 may be implemented as an anti-aliasing (AA) filter 208.

The accelerometer 204 also transmits a reference signal x(n) to the filter control block 218. The filter control block 218 includes an adjustment block 250 (or adjustment controller 250), at least one filter 252 (hereafter "the filter 252"), and an FFT block 254. In one example, the filter 252 may be implemented as an AA filter. In general, the filter control block 218 may automatically adjust the AA filter based on a characteristic of a frequency domain that is present in the reference signal x(n). The filter control block 218 generates a filtered reference signal x' (n) that is provided to the adaptive filter 214. The filtered reference signal x'(n) generally corresponds to a filtered reference signal in which the high frequency component that causes the boosting issue is removed by the AA filter 252 prior to transmission to the adaptive filter 214. The filter control block 218 also provides the filtered reference signal x'(n) to an estimated secondary path $\hat{S}(z)$ 242 and the LMS block 216.

As noted above, the error microphone 206 generates the error microphone signal e(n) which can be expressed as:

$$e(n)=d(n)-y_s(n)=d(n)-y(n)*S(n)$$

Where d(n) is the primary noise signal as output by the accelerometer 204 as the reference signal x(n) traverses the primary path P(x) 240 and $y_s$ (n) is the anti-noise signal filtered by the secondary path S(n) (i.e., in the time domain) (or S(z) in the frequency domain) 241. The adaptive filter 214 generates the anti-noise signal $y_s(n)$ which includes audio that is out of phase with the noise detected in the vehicle 202 in response to the filtered reference signal x'(n) as generated by the filter control block 218 and the error microphone signal e(n) as generated by the error microphone 206. The anti-noise signal $y_s(n)$ serves to cancel the detected undesired noise in the vehicle 202.

It is recognized that the adaptive filter 214 (e.g., W(z)) is updated by the LMS block 216 in response to the error microphone signal e(n) and the filtered reference signal x'(n) prior to generating the anti-noise signal $y_s(n)$. In general, the LMS block 216 may minimize the sum of the squared of residual noise measured by error microphone signal, e(n). Consequently, the adaptive filter coefficients of the adaptive filter 214 is calculated (or updated) by the equation noted directly below. Based on the updated adaptive filter coefficients, the loudspeaker signal, y(n) can be obtained by the filter reference signal x'(n) filtered by the selected AA filter multiple by the updated adaptive filter coefficients.

For example, the adaptive filter coefficients of the adaptive filter 214 may be updated by the following equation:

$$w(n+1)=w(n)+\mu(x'(n)*\hat{S}(n))e(n)$$

Where μ is the step size as determined by a convergence speed of the LMS block 216, $\hat{S}(n)$ (i.e., in the time domain) (or $\hat{S}(z)$ in the frequency domain) is the estimated secondary path 242, and x'(n) is the filtered reference signal that is filtered by the AA filter 208. The adaptive block 218 generally determines the characteristic of reference signal based on the output of the AA filter 252. The AA filter 252 not only ensures the bandwidth of the signal to be sampled but may also limit the additive noise spectrum and other interference, which corrupts the signal. Thus, the estimated secondary path 242 as output from the AA filter 252 (e.g., the filter control block 218) corresponds to a signal that includes a limited additive noise spectrum or other limited interference. The adjustment block 250 automatically adjusts the AA filter 252 based on the characteristic of frequency of the reference signal as transmitted by the accelerometer 204. This aspect will be discussed in more detail in connection with FIG. 4.

Figure 4:
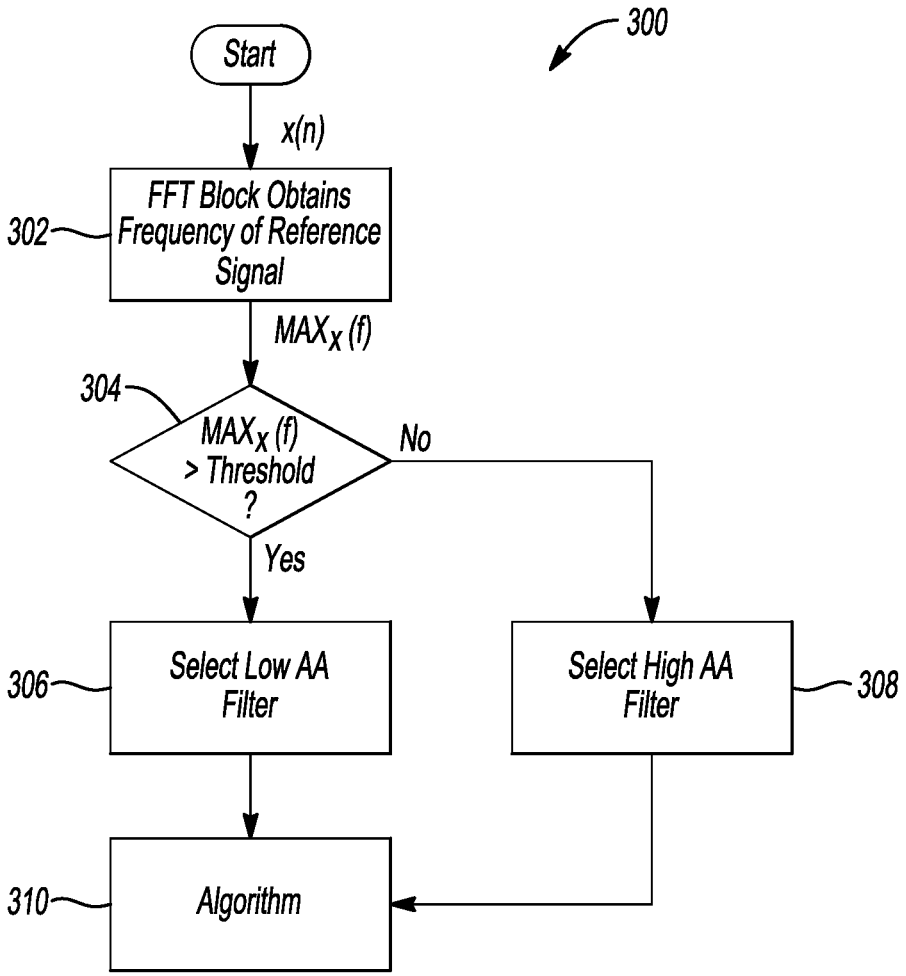
FIG. 4 depicts a method for providing an intelligent adjustment for at least one filter for an RNC in a vehicle in accordance to one embodiment.

FIG. 4 depicts a method 300 for providing an intelligent adjustment for the AA filter 252 for the RNC system 200 in the vehicle 202 in accordance to one embodiment. The operations as performed in connection with the method 300 may be performed by the filter control block 218 (or filter controller). It is recognized that the filter control block 218 may include any number of microprocessors, controllers, etc., memory, and software which co-act with one another to perform the noted operations. Additionally, the microprocessor(s) and/or controller(s) of the filter control block 218 may execute instructions stored on the memory to perform the various operations noted herein.

In operation 302, the FFT block 254 receives the reference signal x(n) from the accelerometer 204 via the AA filter 252. The FFT block 254 takes a maximum frequency of the reference signal x(n) (or accelerometer signal) in a frequency domain to generate $MAX_x(f)$. In this case, $MAX_x(f)$ corresponds to the maximum frequency of the reference signal x(n). While the method 300 (and the system 200) discloses the utilization of the FFT block 254, it is recognized that the FFT block 254 may be optional and that the system 200 and method 300 may extend to active noise cancellation systems not only in a time domain, but also in a time-frequency domain, or the frequency domain.

In operation 304, the adjustment block 250 compares the maximum frequency as identified on $MAX_x(f)$ to a predetermined frequency threshold. If $MAX_x(f)$ is greater than the predetermined frequency threshold, then the method 300 moves to operation 306. If not, then the method 300 moves to operation 308. In the event the system 200 is based in the time frequency domain, then the system 200 does not employ the FFT block 254 and operation 302 is not performed. In this case, the adjustment block 250 may compare the frequency as identified in the reference signal x(n) and compares the frequency to a predetermined frequency threshold that is based in the frequency domain.

Figure 5:
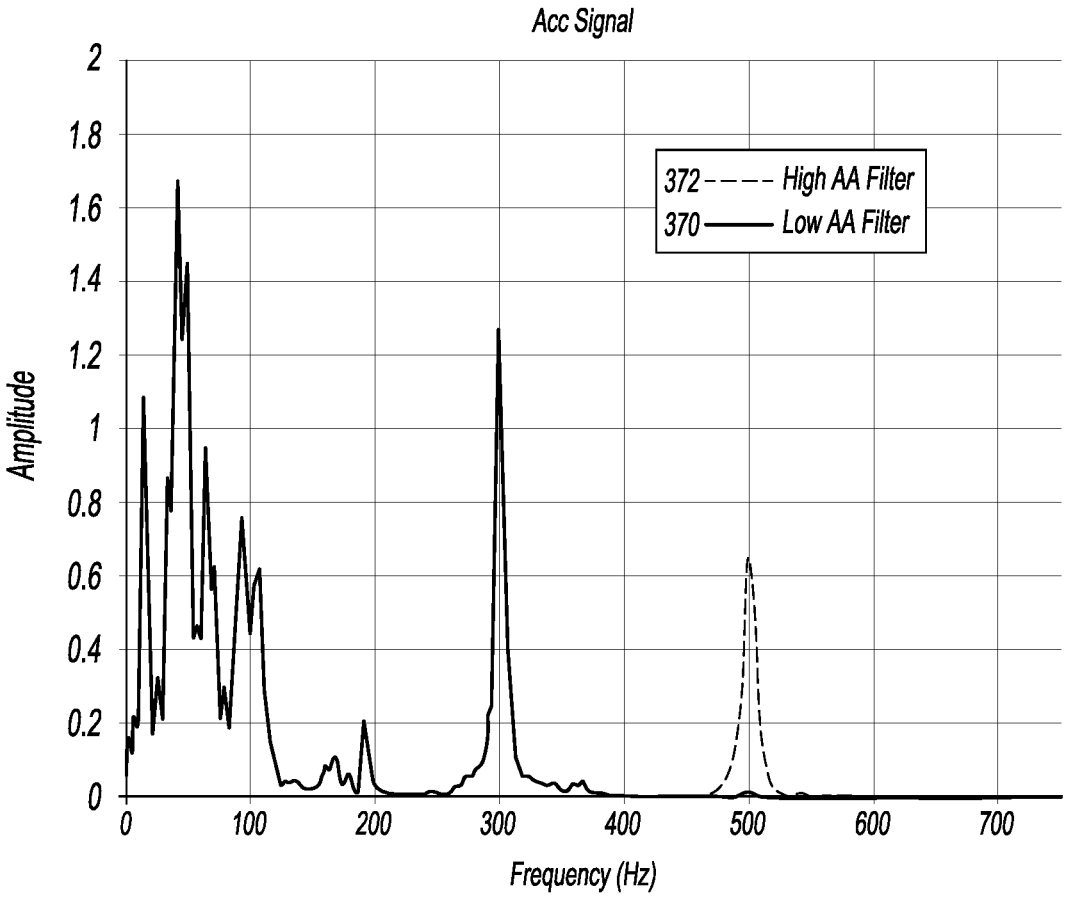
FIG. 5 generally depicts frequencies and corresponding amplitudes for a filter when operating as a low pass filter and a high pass filter in accordance to one embodiment.

In operation 306, the adjustment block 250 controls the AA filter 252 to operate as a low pass filter to filter the maximum frequency from the reference signal x(n) as transmitted from the accelerometer 204. With this aspect, the AA filter 252 is controlled to operate as a low pass filter and allow frequencies that are below the predetermined frequency threshold. When the AA filter 252 is configured to operate as a low pass filter, the AA filter 252 may allow frequencies that are below 400 Hz to pass therethrough. FIG. 5 generally depicts frequencies and corresponding amplitudes for the AA filter 252 when operating as a low pass filter (e.g., see waveform 370). Waveform 370 generally illustrates frequencies that may pass through the AA filter 252 when operating as a low pass filter. As seen, at roughly 400 Hz, any frequency values greater than 400 Hz are filtered by the low pass filter. Referring back to FIG. 4, the adjustment block 250 transmits the filtered reference signal x'(n) to the adaptive filter 214 such that the adaptive filter 214 generates the anti-noise without influence from the high frequency component from the reference signal x(n). This results in a sound pressure reduction in the anti-noise transmitted in the vehicle 202 which leads to a removal of the boosting issue.

In operation 308, the adjustment block 250 controls the AA filter 252 to operate as a high pass filter to enable the maximum frequency as identified on $MAX_x(f)$ (or frequency in the time domain) for purposes of performing RNC in the system 200. When the AA filter 252 operates as a high pass filter, the AA filter 252 may allow frequencies that are slightly less than, equal to, or greater than 500 Hz to pass therethrough. Waveform 372 as illustrated in FIG. 5 generally illustrates the frequencies that may pass through the AA filter 252 when configured as a high pass filter.

Figure 6:
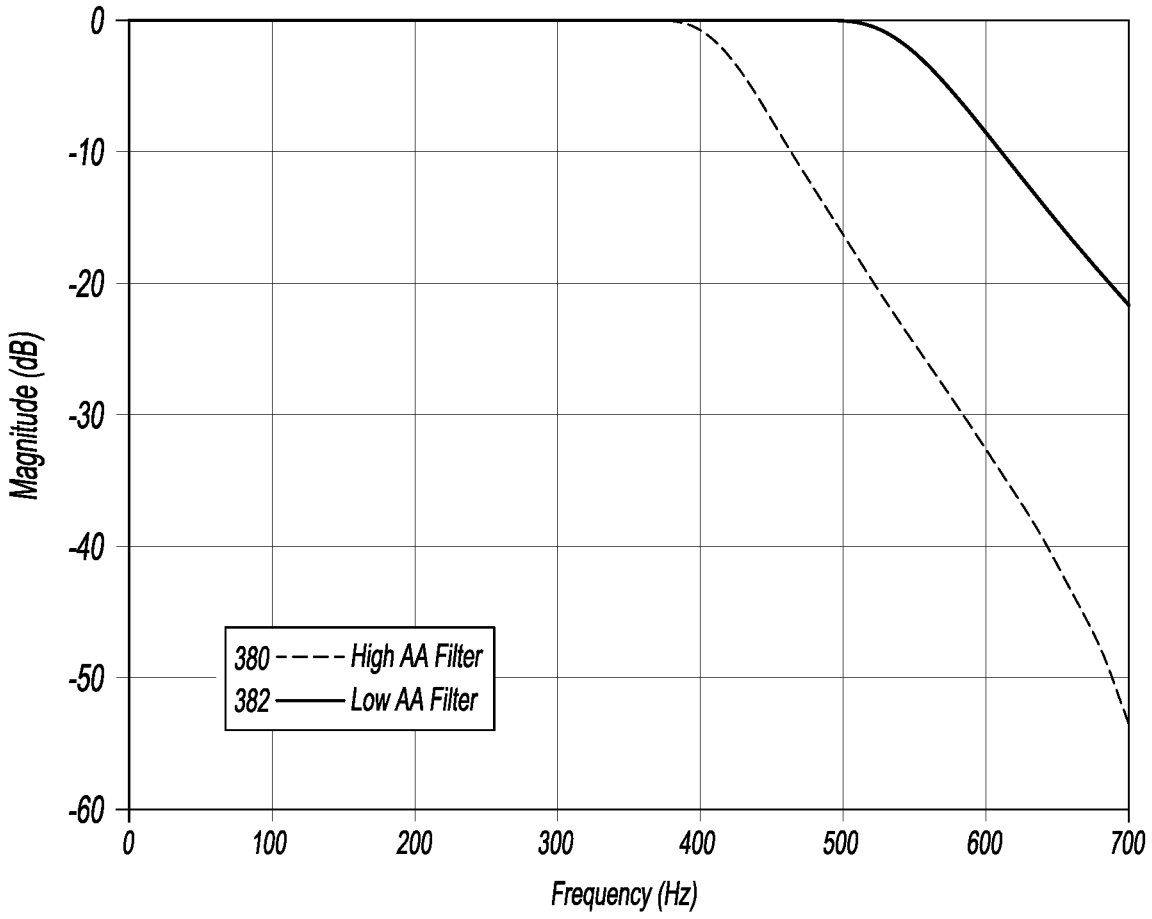
FIG. 6 generally depicts a frequency response for the filter that operates as a low pass filter and as a high pass filter in accordance to one embodiment.

In general, the AA filter 252 may operate as a low pass filter or a high pass filter due to the system 300 being utilized for different vehicles. For example, a single active noise cancellation system (or RNC system) may be developed for a number of different vehicles with different frequency responses. FIG. 6 generally depicts a frequency response for the AA filter 252 that operates as a low pass filter (e.g., see waveform 380) and a frequency response for the AA filter 252 that operates as a high pass filter (e.g., see waveform 382). In particular, the different vehicles include different accelerometer signals having a different frequency response. Based on the differing frequency responses, the AA filter 252 may operate as a low pass filter or a high pass filter.

In operation 310, the system 300 performs the RNC functionality to cancel undesired noise in the cabin of the vehicle 202. The adaptive filter 214 generates a loudspeaker signal y(n) that is indicative of the anti-noise to be generated by the loudspeaker 212 to emit the anti-noise into the cabin of the vehicle 202. In this case, since the high frequency component is not present in the filtered reference signal x'(n) as provided by the AA filter 252, the adaptive filter 214 is not biased based on the high-frequency component on the reference signal x(n) and thus generates anti-noise independent of the high-frequency component. This condition, among other things, avoids the generation of the boosting issue in the vehicle 202.

Figure 7:
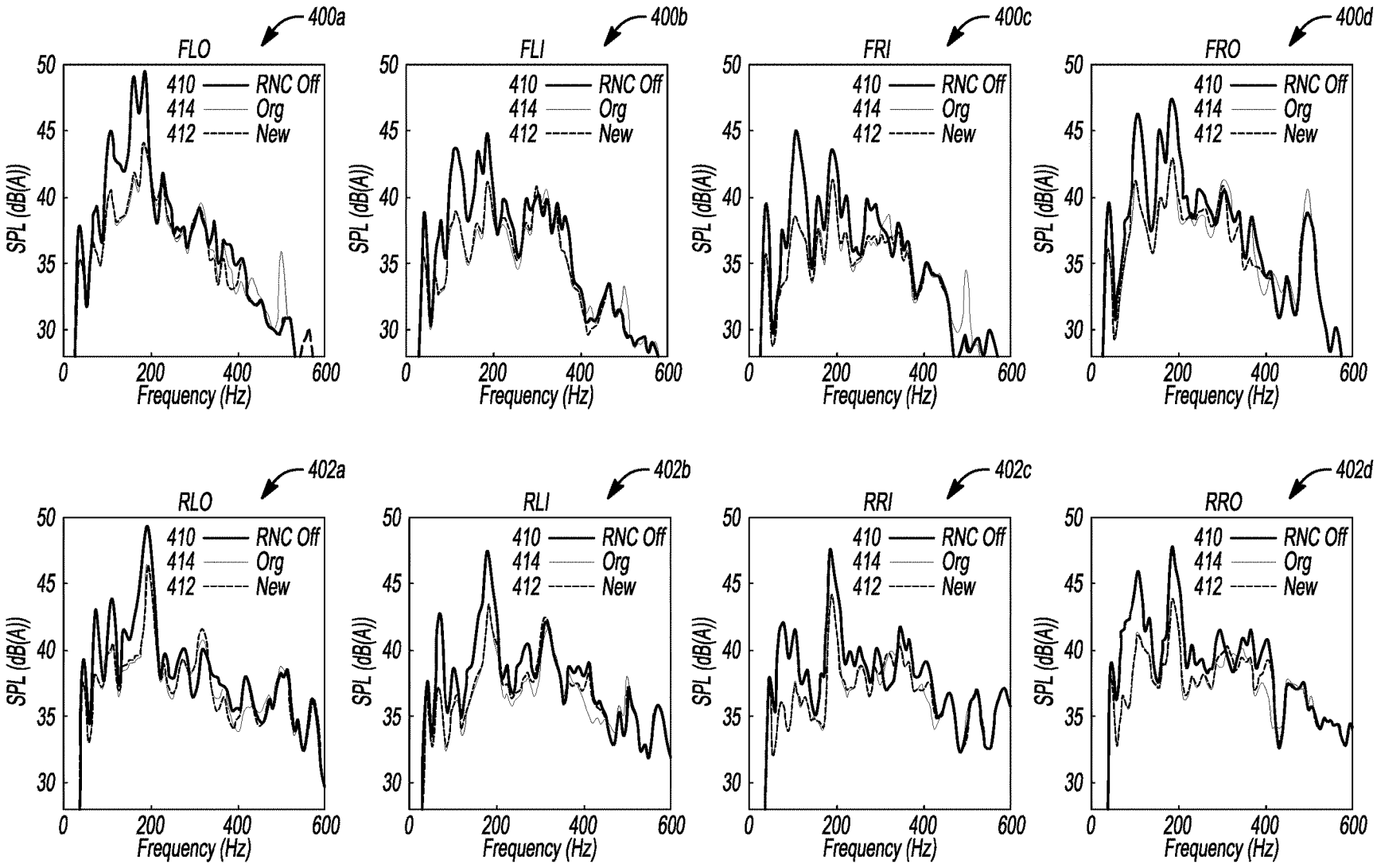
FIG. 7 depicts various plots that illustrate a spectrum of error microphone in the vehicle in which the boosting issue is mitigated via the system of FIG. 3 in accordance to one embodiment.

FIG. 7 depicts various plots 400*a*-400*d* and 402*a*-402*d* that illustrate a spectrum of error microphones in the vehicle 202 that capture frequencies from accelerometers in which the boosting issue is mitigated via the system 200 of FIG. 3 in accordance to one embodiment. Plot 400*a* generally corresponds to the spectrum for the error microphone positioned in a front left side of a vehicle that is close to driver's left ear. Plot 400*b* generally corresponds to the spectrum for the error microphone positioned in a front left side of a vehicle that is close to driver's right ear. Plot 400*c* generally corresponds to the spectrum for the error microphone positioned in a right left side of a vehicle that is close to front passenger's right ear. Plot 400*d* generally corresponds to the spectrum for the error microphone positioned in a front right side of a vehicle that is close to passenger's right ear.

Similarly, plot 402*a* generally corresponds to the spectrum for the error microphone positioned in a rear left side of a vehicle that is close passenger's left ear. Plot 402*b* generally corresponds to the spectrum for the error microphone positioned in a rear left side of a vehicle that is close passenger's right ear. Plot 402*c* generally corresponds to the spectrum for the error microphone positioned in a rear right side of a vehicle that is close passenger's left ear. Plot 402*d* generally corresponds to the spectrum for the error microphone positioned in a rear right side of a vehicle that is close passenger's right ear.

Each of the plots 400*a*-400*d* and 402*a*-402*d* illustrate three waveforms therein. Waveform 410 as illustrated in each of the plots 400*a*-400*d* and 402*a*-402*d* correspond to the spectrum of the error microphone when the RNC system is deactivated. Waveform 412 as illustrated in in each of the plots 100*a*-100*d* and 102*a*-102*d* correspond to the spectrum of the error microphone when the RNC system 200 is activated to mitigate the boosting issue. Waveform 414 as illustrated in each of the plots 400*a*-400*d* and 402*a*-402*d* correspond to the spectrum of the error microphone when the RNC system does not employ any mitigation to remove the boosting issue. In general, at roughly 500 Hz (e.g., the waveform 412 of plots 400*a*, 400*b*, 400*c*, and 400*d*), the effectiveness of the overall mitigation of sound pressure spike when compared to the waveform 410 of corresponding plots 400*a*, 400*b*, 400*c*, and 400*d* can readily be seen. While the mitigation of the sound pressure spikes for plots 402*a*, 402*b*, 402*c* and 402*d* are not as readily pronounced or illustrated for the waveform 412 in comparison to the plots 400*a*, 400*b*, 400*c*, and 400*d*, it is recognized that the RNC system 300 mitigates sound pressure for the accelerometers noted in connection with these plots 402*a*, 402*b*, 402*c*, and 402*d*.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for performing active noise cancelation in a vehicle, the system comprising:

an adaptive filter configured to control a loudspeaker to generate anti-noise to cancel undesired noise in the vehicle; and an adjustment controller programmed to:

receive one or more reference signals from one or more accelerometers, each reference signal includes a frequency that is indicative of a force acting on a portion of the vehicle;

compare the frequency to a predetermined frequency threshold;

control a first filter to filter the frequency of the reference signal after comparing the frequency to the predetermined frequency threshold; and transmit a filtered reference signal to the adaptive filter to generate the anti-noise without influence of the frequency of the reference signal.

2. The system of claim 1, wherein the adjustment controller is programmed to control the first filter to operate as a high pass filter to enable the frequency of the reference signal to pass to the adaptive filter in the event the frequency of the reference signal is less than the predetermined frequency threshold.

3. The system of claim 1, wherein the adjustment controller is programmed to control the first filter to operate as a low pass filter to filter the frequency of the reference signal in the event the frequency of the reference signal is greater than the predetermined frequency threshold.

4. The system of claim 1, wherein the first filter is an anti-aliasing (AA) filter.

5. The system of claim 4, wherein the adjustment controller is programmed to control the AA filter to operate as one of a low pass AA filter or a high pass AA filter based on the comparison of the frequency to the predetermined frequency threshold.

6. The system of claim 1, further comprising a microprocessor programmed to determine a maximum value of the frequency of the reference signal and wherein the adjustment controller is further programmed to compare the maximum value of the frequency to the predetermined frequency threshold prior to controlling the first filter to filter the frequency of the reference signal.

7. The system of claim 1, further comprising a microprocessor programmed to provide a first signal indicative of an estimated secondary path to the adaptive filter.

8. A computer-program product embodied in a non-transitory computer read-able medium that is programmed for performing active noise cancellation in a vehicle, the computer-program product comprising instructions for:

controlling a loudspeaker to generate anti-noise to cancel undesired noise in the vehicle receiving one or more reference signals from one or more accelerometers, each reference signal includes a frequency that is indicative of a force acting on a portion of the vehicle;

comparing the frequency to a predetermined frequency threshold;

controlling a first filter to filter to the frequency of the reference signal after comparing the frequency to the predetermined frequency threshold; and transmitting a filtered reference signal to an adaptive filter to generate the anti-noise without influence of the frequency of the reference signal.

9. The computer-program product of claim 8 further comprising instructions for controlling the first filter to operate as a high pass filter to enable the frequency of the reference signal to pass to the adaptive filter in the event the frequency of the reference signal is less than the predetermined frequency threshold.

10. The computer-program product of claim 8 further comprising instructions for controlling the first filter to operate as a low pass filter to filter the frequency of the reference signal in the event the frequency of the reference signal is greater than the predetermined frequency threshold.

11. The computer-program product of claim 8, wherein the first filter is an anti-aliasing (AA) filter.

12. The computer-program product of claim 11 further comprising instructions for controlling the AA filter to operate as one of a low pass AA filter or a high pass AA filter based on the comparison of the frequency to the predetermined frequency threshold.

13. The computer-program product of claim 8 further comprising instructions for determining a maximum value of the frequency of the reference signal via a microprocessor and for comparing the maximum value of the frequency to the predetermined frequency threshold prior to controlling the first filter to filter the frequency of the reference signal.

14. The computer-program product of claim 8 further comprising instructions for providing a first signal indicative of an estimated secondary path to the adaptive filter.

15. A method for performing active noise cancellation in a vehicle, the method comprising:

controlling a loudspeaker to generate anti-noise to cancel undesired noise in the vehicle receiving one or more reference signals from one or more accelerometers, each reference signal includes a frequency that is indicative of a force acting on a portion of the vehicle;

comparing the frequency to a predetermined frequency threshold;

controlling a first filter to filter to the frequency of the reference signal; and transmitting a filtered reference signal to an adaptive filter to generate the anti-noise without influence of the frequency of the reference signal.

16. The method of claim 15 further comprising instructions for controlling the first filter to operate as a high pass filter to enable the frequency of the reference signal to pass to the adaptive filter in the event the frequency of the reference signal is less than the predetermined frequency threshold.

17. The method of claim 15 further comprising instructions for controlling the first filter to operate as a low pass filter to filter the frequency of the reference signal in the event the frequency of the reference signal is greater than the predetermined frequency threshold.

18. The method of claim 15, wherein the first filter is an anti-aliasing (AA) filter.

19. The method of claim 18 further comprising controlling the AA filter to operate as one of a low pass AA filter or a high pass AA filter based on the comparison of the frequency to the predetermined frequency threshold.

20. The method of claim 15 further comprising determining a maximum value of the frequency of the reference signal via a microprocessor and comparing the maximum value of the frequency to the predetermined frequency threshold prior to controlling the first filter to filter the frequency of the reference signal.

* * * * *